US011242740B2

(12) United States Patent
Comini et al.

(10) Patent No.: US 11,242,740 B2
(45) Date of Patent: Feb. 8, 2022

(54) METHOD OF EVALUATING CEMENT ON THE OUTSIDE OF A WELL CASING

(71) Applicant: Keystone Wireline, Inc., Bradford, PA (US)

(72) Inventors: Martin D. Comini, McMurray, PA (US); Richard A. Carpenter, Bradford, PA (US)

(73) Assignee: Keystone Wireline, Inc., Bradford, PA (US)

( * ) Notice: Subject to any disclaimer, the term of this patent is extended or adjusted under 35 U.S.C. 154(b) by 575 days.

(21) Appl. No.: 16/193,188

(22) Filed: Nov. 16, 2018

(65) Prior Publication Data

US 2019/0153850 A1 May 23, 2019

Related U.S. Application Data

(60) Provisional application No. 62/587,945, filed on Nov. 17, 2017.

(51) Int. Cl.

| | |
|---|---|
| ***E21B 47/005*** | (2012.01) |
| ***E21B 49/00*** | (2006.01) |
| ***E21B 47/12*** | (2012.01) |
| ***E21B 47/09*** | (2012.01) |
| ***E21B 47/11*** | (2012.01) |

(52) U.S. Cl.

CPC ..... *E21B 47/005* (2020.05); *E21B 47/09* (2013.01); *E21B 47/11* (2020.05); *E21B 47/12* (2013.01); *E21B 49/00* (2013.01)

(58) Field of Classification Search

CPC .. G01F 1/56; G01F 1/662; G01F 1/06; G01V 5/125; G01V 3/18; G01V 5/104; E21B 49/08; E21B 47/12; E21B 47/005; E21B 47/01; E21B 47/07; E21B 47/09

See application file for complete search history.

(56) References Cited

U.S. PATENT DOCUMENTS

| | | | | |
|---|---|---|---|---|
| 3,864,569 | A * | 2/1975 | Tittman | G01V 5/125 250/264 |
| 4,102,396 | A * | 7/1978 | Ransom | E21B 43/16 166/252.2 |
| 5,415,037 | A * | 5/1995 | Griston | E21B 47/07 73/152.12 |

(Continued)

FOREIGN PATENT DOCUMENTS

| | | | |
|---|---|---|---|
| WO | 0054009 | A2 | 9/2000 |
| WO | 2015153771 | A1 | 10/2015 |

*Primary Examiner* — Regis J Betsch
*Assistant Examiner* — Kaleria Knox
(74) *Attorney, Agent, or Firm* — The Webb Law Firm

(57) ABSTRACT

A method of logging a wellbore casing and an adjacent formation comprises moving a measurement tool inside a borehole of the casing, wherein the casing is filled with air. Concurrently with moving the measurement tool inside the borehole, the method comprises emitting radioactive energy at an initial energy level from a radiation source of the measurement tool, wherein the radioactive energy is directed toward a wall of the casing and along a travel path from the radiation source to one or more detectors of the measurement tool, measuring energy loss of the radioactive energy at the one or more detectors relative to the initial energy level, and detecting a cement property outside of the casing based on the measured energy loss.

18 Claims, 9 Drawing Sheets

(56) References Cited

U.S. PATENT DOCUMENTS

| | | | | |
|---|---|---|---|---|
| 6,207,953 | B1 * | 3/2001 | Wilson | G01V 5/104 250/269.4 |
| 7,292,942 | B2 | 11/2007 | Ellis et al. | |
| 9,175,559 | B2 | 11/2015 | Dowla et al. | |
| 9,383,473 | B2 | 7/2016 | Guo | |
| 9,540,927 | B2 | 1/2017 | Mann et al. | |
| 10,209,395 | B2 * | 2/2019 | Hu | E21B 47/005 |
| 2011/0068788 | A1 * | 3/2011 | Minh | G01V 3/18 324/303 |
| 2011/0290011 | A1 * | 12/2011 | Dowla | E21B 47/09 73/152.16 |
| 2012/0230151 | A1 | 9/2012 | Almaguer | |
| 2014/0216734 | A1 | 8/2014 | Hupp | |
| 2016/0053608 | A1 | 2/2016 | Dowla et al. | |

* cited by examiner

METHOD OF EVALUATING CEMENT ON THE OUTSIDE OF A WELL CASING

CROSS-REFERENCE TO RELATED APPLICATION

This application claims priority to U.S. provisional patent application No. 62/587,945, filed on Nov. 17, 2017 and entitled "Method of Evaluating Cement on the Outside of a Well Casing", the disclosure of which is hereby incorporated by reference in its entirety.

BACKGROUND OF THE INVENTION

Field of the Invention

This invention relates generally to systems and methods for evaluating cement on the outside of a well casing. More particularly, the invention relates to methods for evaluating the presence, quality, and quantity of cement on the outside of a well casing which is filled with air, for example, the level of the top of the cement surrounding the outside of the well casing.

Description of Related Art

A typical installment of oil or gas well may include a well casing installed in the wellbore. Once the casing is placed in the wellbore, cement is pumped down the borehole of the casing and forced up the outside (backside) of the casing, forming a barrier between the casing and the surrounding earth. The barrier formed by the cement on the outside of the well casing protects the surrounding earth from contamination during service of the well and after the well is abandoned, as well as maintaining the casing in position. The cement barrier can be helpful to protect aquifers in the surrounding earth from the flow of contents from the well.

Title 25, Chapter 78, Subchapter D of the Pennsylvania Administrative Code governs the drilling, operation, and plugging of oil and gas wells in Pennsylvania and is incorporated by reference herein. In particular, 25 Pa. Code § 78.85 governs cement standards and § 78.102 governs the approval of inactive well status. Recently, Pennsylvania has adopted more stringent regulations requiring testing to determine the top of the cement level on the outside of the casing, as set forth in 25 Pa. Code §§ 78.83, 78.83b. Similar laws and regulations may exist in other states and/or jurisdictions. To ensure that the well is environmentally acceptable, the level of the cement on the outside of the casing is verified to be of sufficient height and quality to protect aquifers and other features of the surrounding earth.

Ideally, the cement is pumped into the bore of the casing until it reaches the ground surface of the well on the outside of the casing, such that the cement is visible from the surface. In this case, no special equipment or method is needed to verify the top of cement level. Oftentimes, however, the casing cement is not installed completely to the surface of the well, and, as such, the top of cement level is not visually verifiable. In order to locate the top of cement, specialized equipment and methods are employed to detect the presence or absence of cement on the outside of the casing from the bore of the casing. Typically, apparatuses, systems, and methods for this purpose include a measurement probe which is lowered into the casing and emits electromagnetic, sonic, or nuclear radiation which penetrates the casing. The probe then detects energy loss of the emitted radiation and converts the energy loss into a cement bond log (CBL), which may be analyzed to determine the top of cement level. Additionally, the CBL may be used to analyze qualitative properties of the cement on the outside of the casing.

Heretofore, a severe limitation of the apparatuses, systems, and methods for detecting cement on the outside of a well casing is that the measurement probes are only effective and accurate when used in homogeneous, stagnate liquids. Thus, prior to inserting the measurement probe into the casing, the casing had to be filled with such a medium, generally fresh water with minimum impurities. The necessity of filling a wellbore with liquid prior to inserting the probe adds significant time, cost, and safety concerns to the process of determining the top of cement level.

U.S. Patent Application Publication No. 2016/0053608 to Dowla et al. discloses systems and methods for measuring and/or detecting features of a well casing, such as a casing collar which connects two sections of the well casing. Dowla et al. discloses the use of a measurement tool lowered into a well casing, particularly during live well drilling. Dowla et al. discloses several means of feature detection and logging, including sonic, nuclear, gamma ray, photoelectric, and resistivity. However, Dowla et al. does not consider the use of radioactive logging in an air-filled well casing to determine the top of the cement level.

Radioactive logging using an air medium is known in the art for open bore wells—that is, wells which do not include a casing. However, as of yet, the use of radioactive logging in an air medium has not been adapted to wells which include a casing.

Determination of top of cement level, as well as the quality of the cement, as described above, is necessary not only in new well applications, but also in storage wells and wells which are being plugged and abandoned.

A need exists for systems and methods of determining the presence and quality of cement on the outside of a well casing independent of the borehole medium. Particularly, a need exists for determining the presence and quality of cement when the well casing medium is air.

SUMMARY OF THE INVENTION

In some examples, the present invention generally relates to a method of logging a wellbore casing and an adjacent formation, the method comprising moving a measurement tool inside a borehole of the casing, wherein the borehole is filled with air. Concurrently with moving the measurement tool inside the borehole, the method comprises emitting radioactive energy at an initial energy level from a radiation source of the measurement tool, wherein the radioactive energy is directed toward a wall of the casing and along a travel path from the radiation source to one or more detectors of the measurement tool, measuring energy loss of the radioactive energy at the one or more detectors relative to the initial energy level, and detecting a cement property outside of the casing based on the measured energy loss.

In some examples, detecting a cement property outside of the casing comprises transmitting the measured energy loss to a computing device; and generating, with at least one processor of the computing device, a log of the measured energy loss as a function of depth of the measurement tool in the wellbore.

In some examples, detecting a cement property outside of the casing comprises detecting the presence or absence of cement between the casing and the formation.

In some examples, detecting a cement property outside of the casing comprises detecting the quality of cement present between the casing and the formation.

In some examples, the radiation source comprises Cesium-137.

In some examples, the Cesium-137 has a Curie strength of 1.8 to 2.0 curie.

In some examples, the radioactive energy is a gamma ray.

In some examples, the gamma ray is emitted at an energy level of 660 kilo-electronvolts.

In some examples, moving the measurement tool inside the borehole copmrises lowering the measurement tool into the borehole to a predetermined depth with a caliper arm of the measurement tool retracted, extending the caliper arm to brace the measurement tool against the borehole, and raising the measurement tool from the predetermined depth out of the borehole.

In some examples, the measurement tool has a depth of measurement of up to 6 inches.

In some examples, the measurement tool has a vertical resolution of 10 inches.

The present invention also relates to a system for logging a wellbore casing and an adjacent formation of a wellbore, the system comprising a measurement tool configured to be moved inside a borehole of the casing. The measurement tool comprises a radiation source configured to emit radioactive energy at an initial energy level directed toward a wall of the casing and along a travel path, and one or more detectors configured to measure energy loss of the radioactive energy relative to the initial energy level and generate one or more measurement signals based on the measured energy loss. The one or more detectors are configured to measure energy loss when the wellbore is filled with air. The system further comprises a computing device configured to receive the one or more measurement signals, the computing device comprising at least one processor configured to convert the one or more measurement signals into a graphical log of the wellbore, and a wireline extending between the measurement tool and the computing device, the wireline configured to carry instructions from computing device to the measurement tool and to carry the one or more measurement signals from the measurement tool to the computing device.

In some examples, the radiation source comprises Cesium-137.

In some examples, the Cesium-137 has a Curie strength of 1.8 to 2.0 curie.

In some examples, the radioactive energy is a gamma ray.

In some examples, the gamma ray is emitted at an energy level of 660 kilo-electronvolts.

In some examples, the measurement tool configured to be moved inside the borehole of the casing by lowering the measurement tool into the borehole to a predetermined depth with a caliper arm of the measurement tool retracted, extending the caliper arm to brace the measurement tool against the borehole, and raising the measurement tool from the predetermined depth out of the borehole.

In some examples, the measurement tool has a depth of measurement of up to 6 inches.

In some examples, the measurement tool has a vertical resolution of 10 inches.

In some examples, the computing device is configured to detecting a cement property outside of the casing based on the one or more measurement signals.

These and other features and characteristics of the methods and systems for logging a wellbore casing and an adjacent formation will become more apparent upon consideration of the following description and the appended claims with reference to the accompanying drawings, all of which form a part of this specification. It is to be expressly understand, however, that the drawings are for the purpose of illustration and description only. In the drawings, like reference numerals designate like components and steps unless noted to the contrary.

DESCRIPTION OF THE INVENTION

Figure 1:
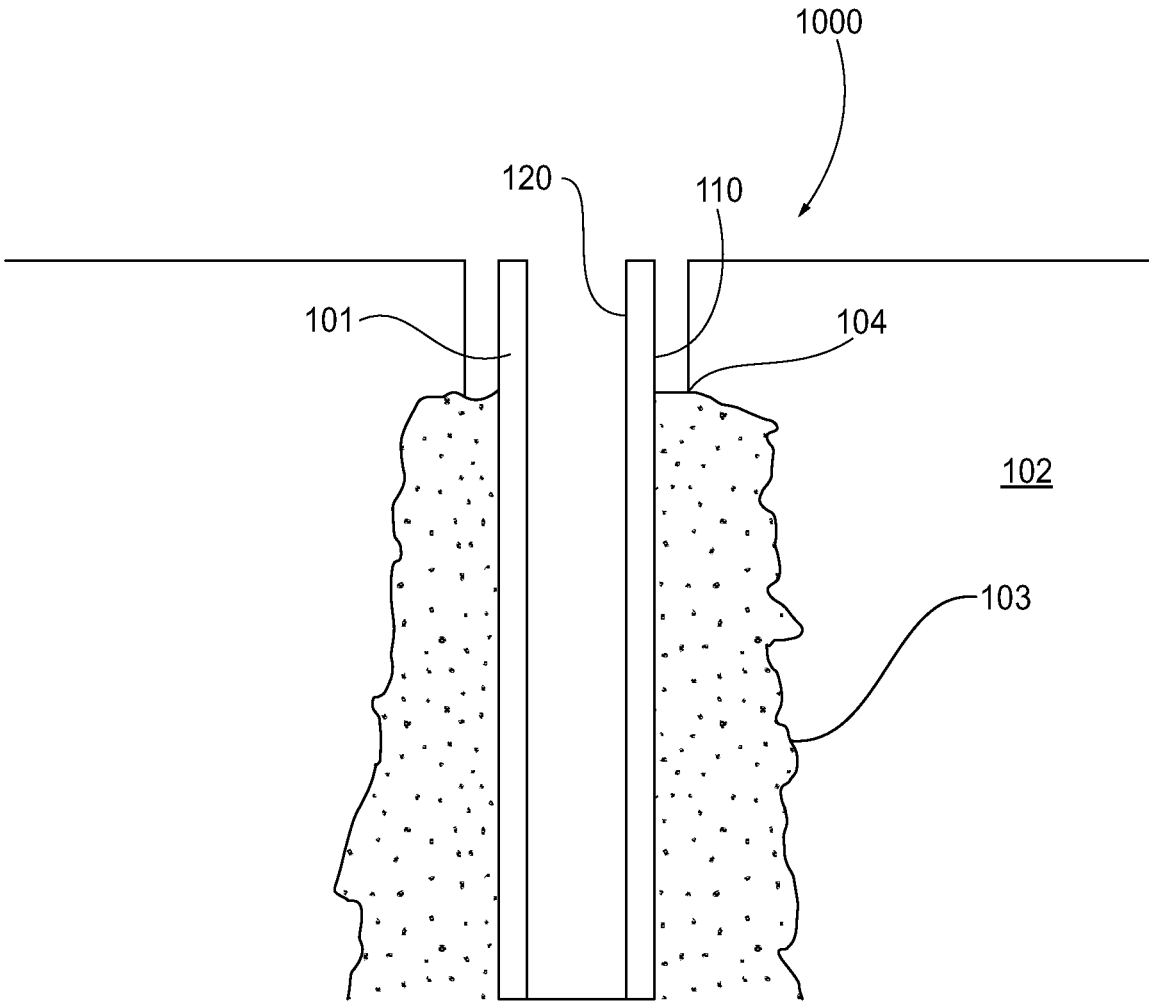
FIG. 1 is a cross sectional diagram of a wellbore suitable for use with the method of the present invention.
Figure 2:
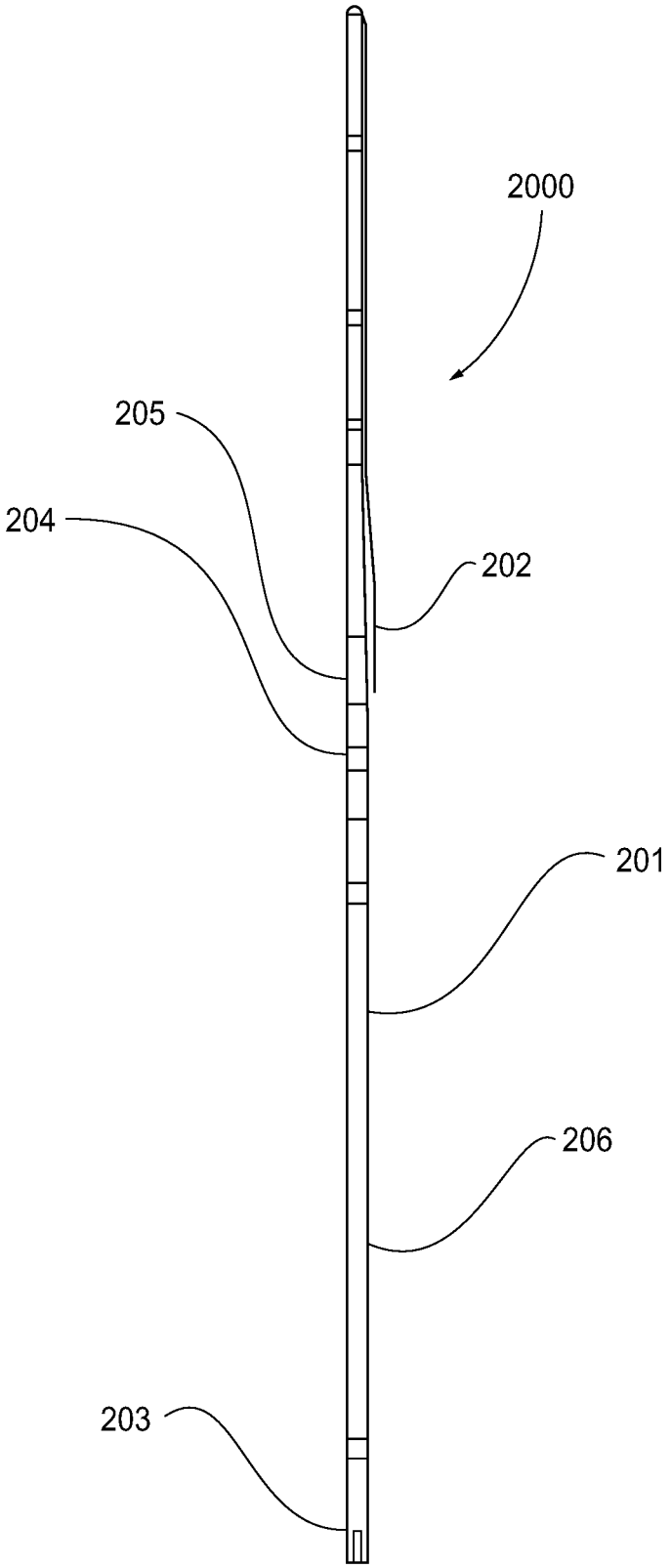
FIG. 2 is a schematic view of an exemplary downhole measurement tool with dimensional data for use with the method and system of the present invention.

For purposes of the description hereinafter, the terms "upper", "lower", "right", "left", "vertical", "horizontal", "top", "bottom", and derivatives thereof, shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply examples of the invention. Hence, specific dimensions and other physical characteristics related to the examples disclosed herein are not to be considered as limiting.

As used herein, the term "at least one of" is synonymous with "one or more of". For example, the phrase "at least one of A, B, and C" means any one of A, B, and C, or any combination of any two or more of A, B, and C. For example, "at least one of A, B, and C" includes one or more of A alone; or one or more B alone; or one or more of C alone; or one or more of A and one or more of B; or one or more of A and one or more of C; or one or more of B and one or more of C; or one or more of all of A, B, and C. Similarly, as used herein, the term "at least two of" is synonymous with "two or more of". For example, the phrase "at least two of D, E, and F" means any combination of any two or more of D, E, and F. For example, "at least two of D, E, and F" includes one or more of D and one or more of E; or one or more of D and one or more of F; or one or more of E and one or more of F; or one or more of all of D, E, and F.

As used herein, the terms "communication" and "communicate" may refer to the reception, receipt, transmission, transfer, provision, and/or the like, of information (e.g., data, signals, messages, instructions, commands, and/or the like).

For one unit (e.g., a device, a system, a component of a device or system, combinations thereof, and/or the like) to be in communication with another unit means that the one unit is able to directly or indirectly receive information from and/or transmit information to the other unit. This may refer to a direct or indirect connection (e.g., a direct communication connection, an indirect communication connection, and/or the like) that is wired and/or wireless in nature. Additionally, two units may be in communication with each other even though the information transmitted may be modified, processed, relayed, and/or routed between the first and second unit. For example, a first unit may be in communication with a second unit even though the first unit passively receives information and does not actively transmit information to the second unit. As another example, a first unit may be in communication with a second unit if at least one intermediary unit (e.g., a third unit located between the first unit and the second unit) processes information received from the first unit and communicates the processed information to the second unit. In some non-limiting examples, a message may refer to a network packet (e.g., a data packet, and/or the like) that includes data. It will be appreciated that numerous other arrangements are possible.

As used herein, the terms "computer" and "computing device" may refer to one or more electronic devices that are configured to directly or indirectly communicate with or over one or more networks. The computing device may be a mobile device. As an example, a mobile device may include a cellular phone (e.g., a smartphone or standard cellular phone), a portable computer, a personal digital assistant (PDA), and/or other like devices. In other aspects, the computing device may be a desktop computer or other non-mobile computer. Furthermore, the term "computer" may refer to any computing device that includes the necessary components to receive, process, and output data and normally includes a display, a processor, a memory, an input device, and a network interface. An "application programming interface" (API) refers to computer code or other data sorted on a computer-readable medium that may be executed by a processor to facilitate the interaction between software components, such as a client-side front-end and/or server-side back-end for receiving data from the client. A "graphical user interface" or "GUI" refers to a generated display with which a user may interact, either directly or indirectly (e.g., through a keyboard, mouse, touchscreen etc.).

Referring now to FIG. 1, a typical wellbore, generally designated as 1000, for which the method of the present invention is adapted for use, comprises a well casing 101 extending vertically down the wellbore 1000. A cement layer 103 is located between the outside 110 of the well casing 101 and the surrounding earth formation 102. The cement layer 103 extends up the outside 110 of the well casing 101 and terminates at a top of cement ("TOC") 104. As may appreciated from FIG. 1, the TOC 104 is not readily visible as it hidden between the well casing 101 and the surrounding earth formation 102. The method of the present invention is directed to a method of determining the location of the TOC 104 using downhole measurement tool(s) 2000 (see FIGS. 2-5) situated in the bore of the well casing 101.

The bore of the well casing 101 may be filled with any suitable medium such as air, gas, brine water, or gas-cut fluids. Importantly, the method of the present invention is not reliant on the well casing 101 being filled with any particular medium in order to determine the location of the TOC 104.

To determine the location of the TOC 104, a measurement tool 2000 is inserted into the inside 120 of the bore of the well casing 101. As may be appreciated from FIGS. 2-5, the measurement tool 2000 comprises a body such as generally a cylindrical body 201, which is attached to a lowering or raising mechanism, such as a wireline 3000 (see FIG. 7), such that the measurement tool 2000 may be lowered into and retrieved from the bore of the well casing 101. Optionally, the wireline 3000 may facilitate communication between the measurement tool 2000 and an operator 5000 and/or a computing device 4000 (see FIG. 7) located at the surface of the wellbore 1000. Alternatively, communication between the measurement tool 2000 and an operator 5000 and/or computing device 4000 can be wireless.

In some examples, the measurement tool 2000 further comprises a caliper arm 202 which is extendable and retractable from the body 201. The caliper arm 202 is typically placed in the retracted position, shown in FIG. 3, for lowering into the well casing 101. A skid 206 is located on the measurement tool 2000 opposite the caliper arm 202. In the retracted position, friction between the measurement tool 2000 and the bore of the well casing 101 is reduced such the measurement tool 2000 may be smoothly lowered into the well casing 101. The caliper arm 202 may be placed in the extended position, as shown in FIG. 4, for raising out of the well casing 101. In particular, once the measurement tool 2000 is lowered to a predetermined maximum depth, the caliper arm 202 is extended to engage the inside 120 of the bore of the well casing 101. This engagement also forces the skid 206 into contact with the inside 120 of the bore of the well casing 101 opposite the caliper arm 202. Extension of the caliper arm 202 can be achieved via an instruction sent from the operator 5000 and/or computing device 4000 down the wireline 3000, or wirelessly, to the measurement tool 2000.

Figure 3:
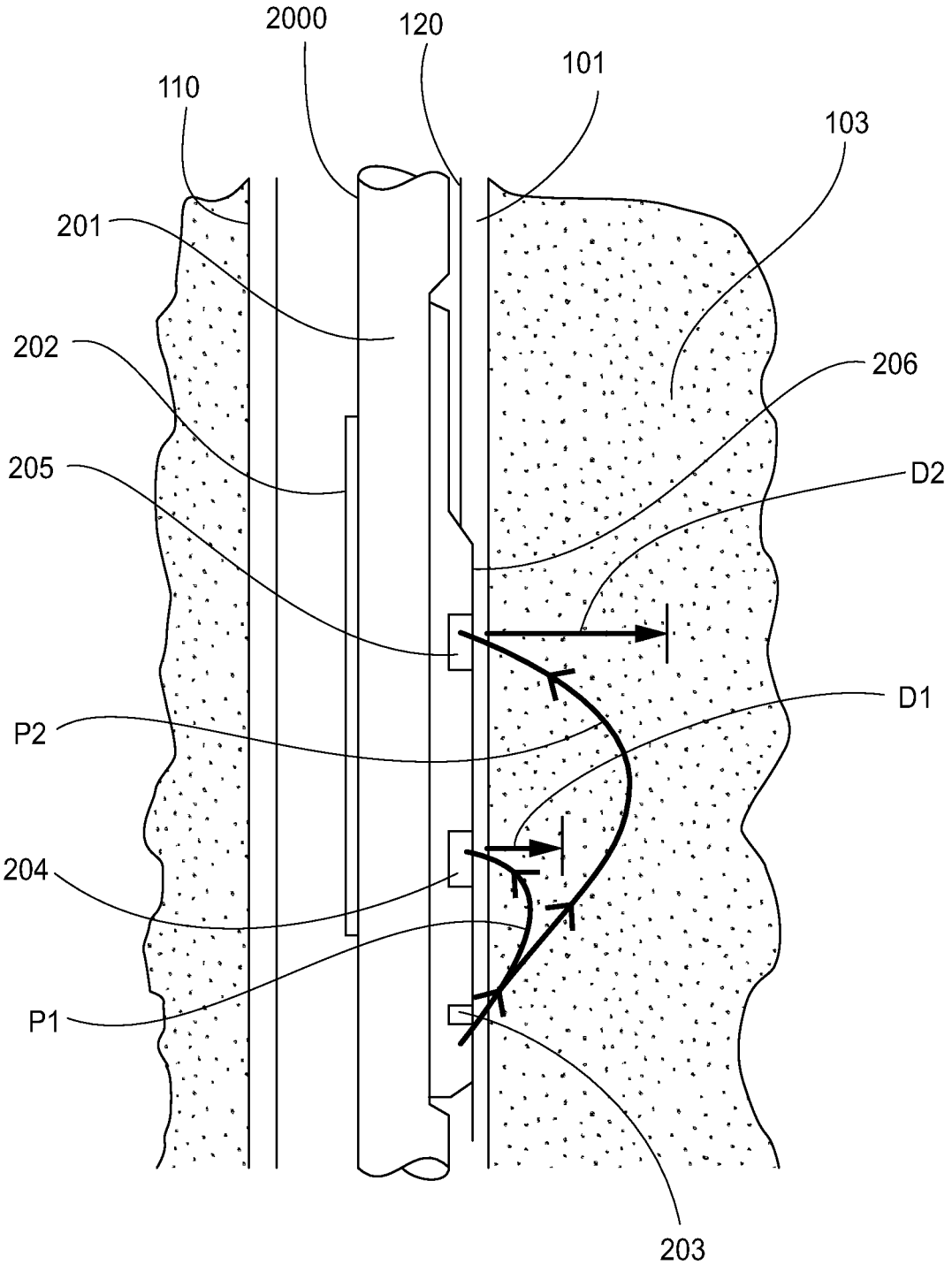
FIG. 3 is a further schematic view of the measurement tool of FIG. 2; with a caliper arm retracted and the a skid on the tool opposite the caliper.
Figure 4:
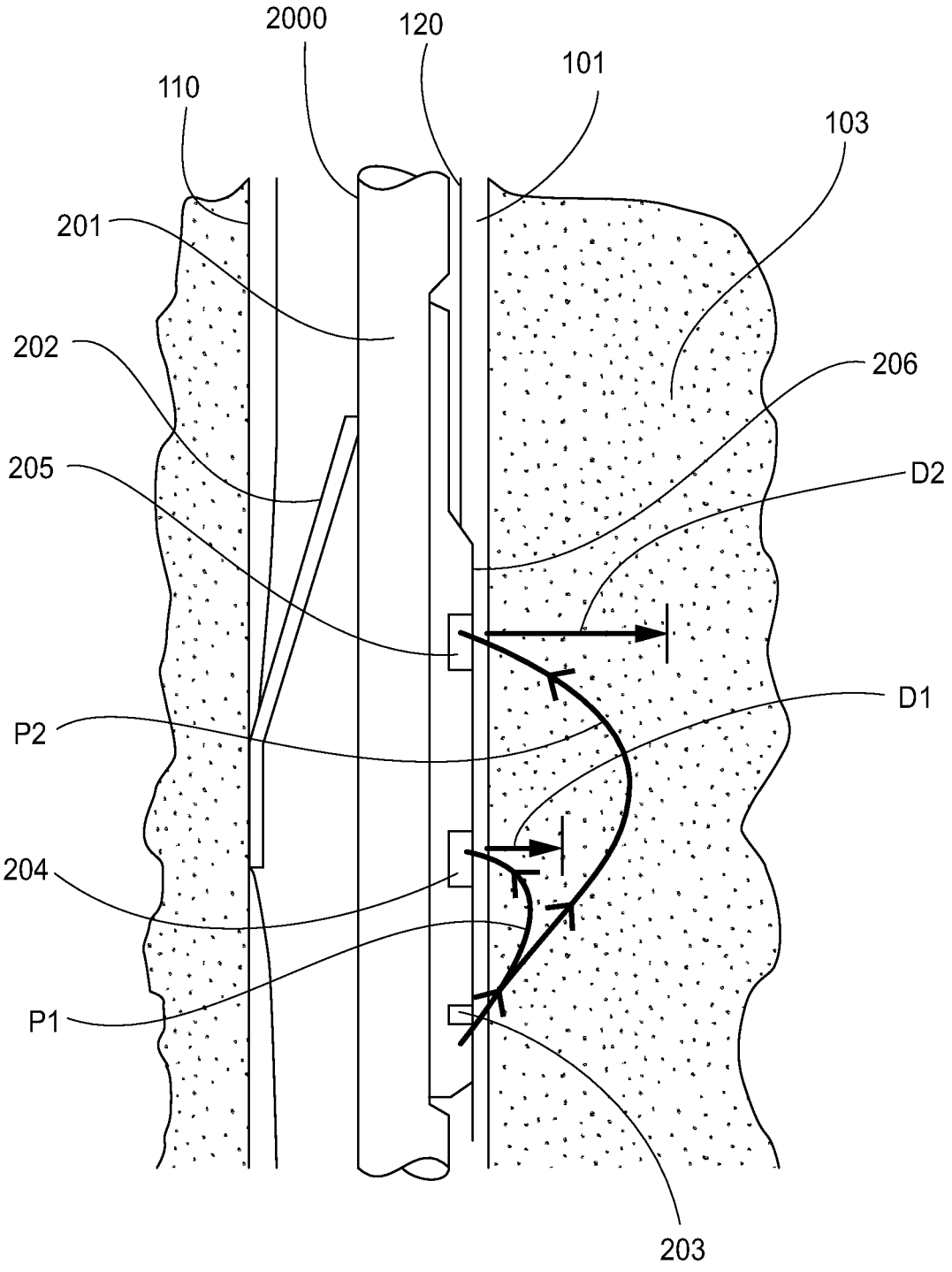
FIG. 4 is a further schematic view of the measurement tool of FIG. 3; with the caliper arm extended.
Figure 5:
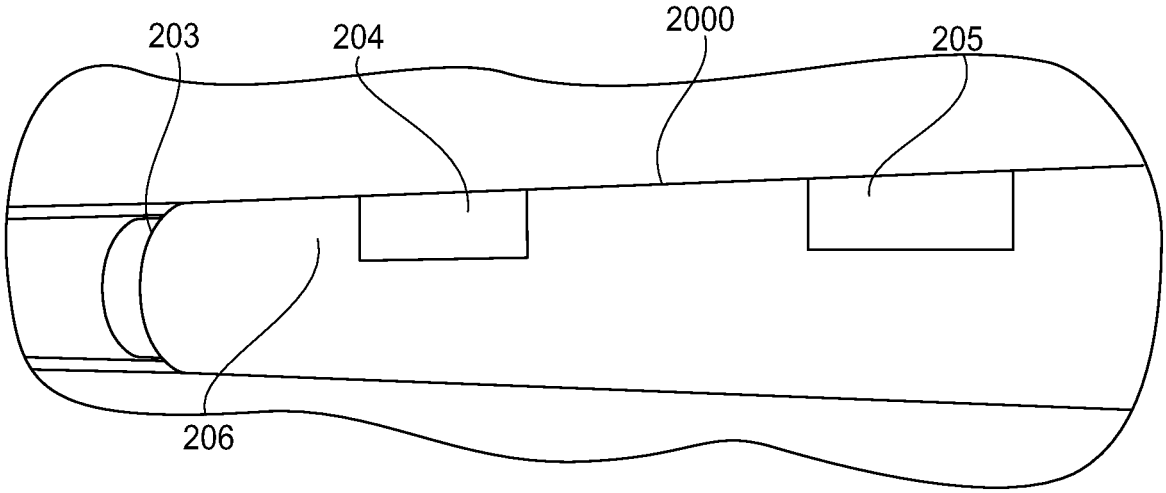
FIG. 5 is a photograph of the skid of an exemplary measurement tool.

With continued reference to FIGS. 2-5, the measurement tool 2000 comprises a radiation source 203 configured to emit radioactive gamma rays toward the well casing 101. In a particular configuration in which the wellbore medium is air, the radiation source may comprise, for example, Cesium-137 having a Curie strength of 1.8 to 2.0 curie. The gamma rays are emitted from the radiation source 203 at a predetermined energy level, for example 660 kilo-electron-volts. The measurement tool 2000 further comprises one or more detectors 204, 205. The one or more detectors 204, 205 are positioned along the skid 206 of the measurement tool 2000 and are calibrated to measure radioactive energy present at the respective locations of the detectors 204, 205. In particular, the one or more detectors 204, 205 measure the energy of the gamma rays emitted from the radiation source 203 after the gamma rays have penetrated the well casing 101 and the structure on the outside 110 of the well casing 101. As the gamma rays penetrate the well casing 101 and the structure on the outside 110 of the well casing 101, the gamma rays lose energy. The one or more detectors 204, 205 are calibrated to measure the energy loss of the gamma rays at a predetermined depth perpendicular to the wall of the wellbore casing 101. For example, FIGS. 3-4 show a short space detector (SSD) 204 and a long space detector (LLS) 205 arranged at different locations along the skid 206 of the measurement tool 2000 and calibrated to measure at different depths D1, D2, respectively. Further, the spacing of the SSD 204 and the LLS 205 determines the vertical resolution of the measurement tool 2000. A short gamma ray travel path P1 corresponds to the energy loss measurement obtained by the SSD 204, and a long gamma ray travel path P2 corresponds to the energy loss measurement obtained by the LLS 205. As may be appreciated from FIGS. 3-4, the long gamma ray travel path P1 may be longer than the short gamma ray travel path P2. In some examples, the depth of measurement is about 4 inches to about 8 inches, or approximately 6 inches. In some examples, the vertical resolution is about 6 inches to about 14 inches, or approximately 10 inches.

Figure 6:
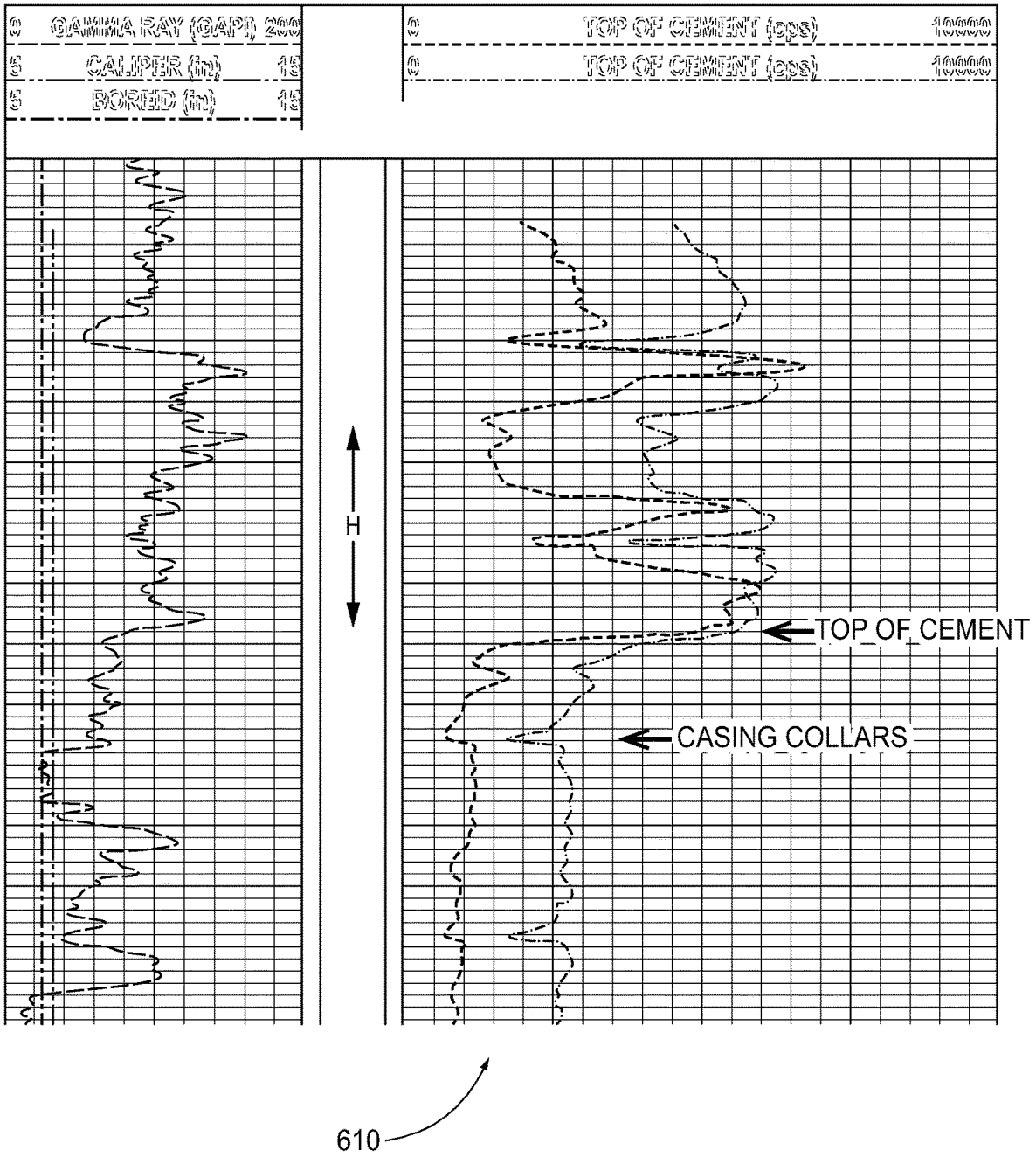
FIG. 6 is an example of a wellbore log generated by the method of the present invention.

To communicate the energy loss measurements taken by the one or more detectors 204, 205, each of the one or more detectors 204, 205 generates a measurement signal which is sent via the wireline 3000, or wirelessly, to the computing device 4000. At least one processor 401 of the computing device 4000 may convert the measurement signal generated by the one or more detectors 204, 205 into a graphical or numerical representation of the energy loss at a given location within the wellbore 1000. Measurements taken at sequential locations within the well casing 101 may be used to generate a log 610 of the wellbore 1000 as shown in FIG. 6, which may be presented on a GUI generated by the computing device 4000. Utilizing the principle that the amount of energy lost from the gamma rays is a function of the material that the gamma ray is passing through, the location of the top of cement 104 can be identified by a change in the energy measured over the log 610 of the wellbore 1000. Similarly, the location of any casing collars can be identified by a change in the energy measured over the log 610 of the wellbore 1000.

Figure 7:
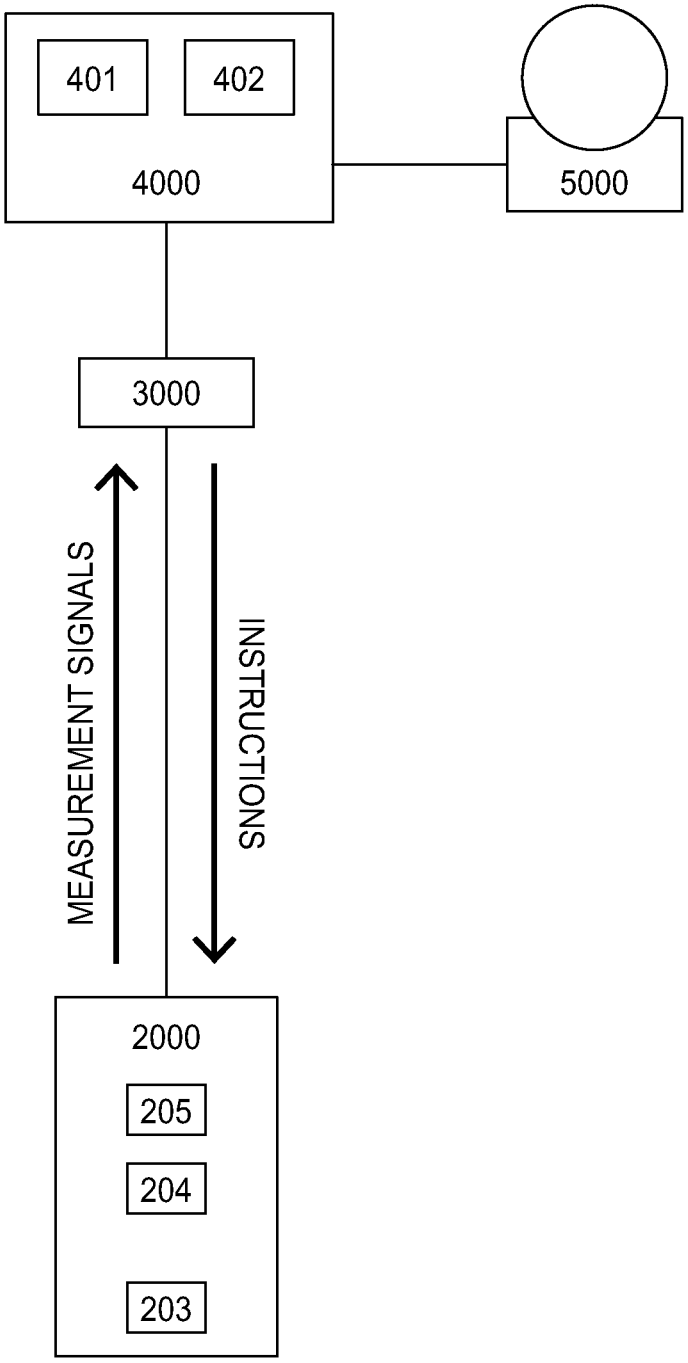
FIG. 7 is a system diagram of an example of the present invention.

Referring now to FIG. 7, a system diagram of the components necessary to carry out the method of the present invention comprises the measurement tool 2000 having the radiation source 203 and one or more detectors 204, 205. The measurement tool 2000 may be connected to one end of the wireline 3000. Another end of the wireline 3000 may be connected to the computing device 4000, which comprises at least one processor 401. An operator 5000 may communicate through an interface 402 of the computing device 4000. The wireline 3000 can facilitate communication between the measurement tool 2000 and the computing device 4000 and/or the operator 5000. Particularly, the wireline 3000 can carry instructions from the computing device 4000 to the measurement tool 2000, such as instructions to open the caliper arm 202, instructions to close the caliper arm 202, instructions to emit gamma rays from the radiation source 203, and instructions for the one or more detectors 204, 205 to generate a measurement signal. Additionally, the wireline 3000 can carry a measurement signal generated by the one or more detectors 204, 205 to the computing device 4000. Alternatively, the measurement tool 2000 may communicate with the computing device 4000 and/or the operator 5000 wirelessly, without communications being transmitted via the wireline 3000.

Figure 8:
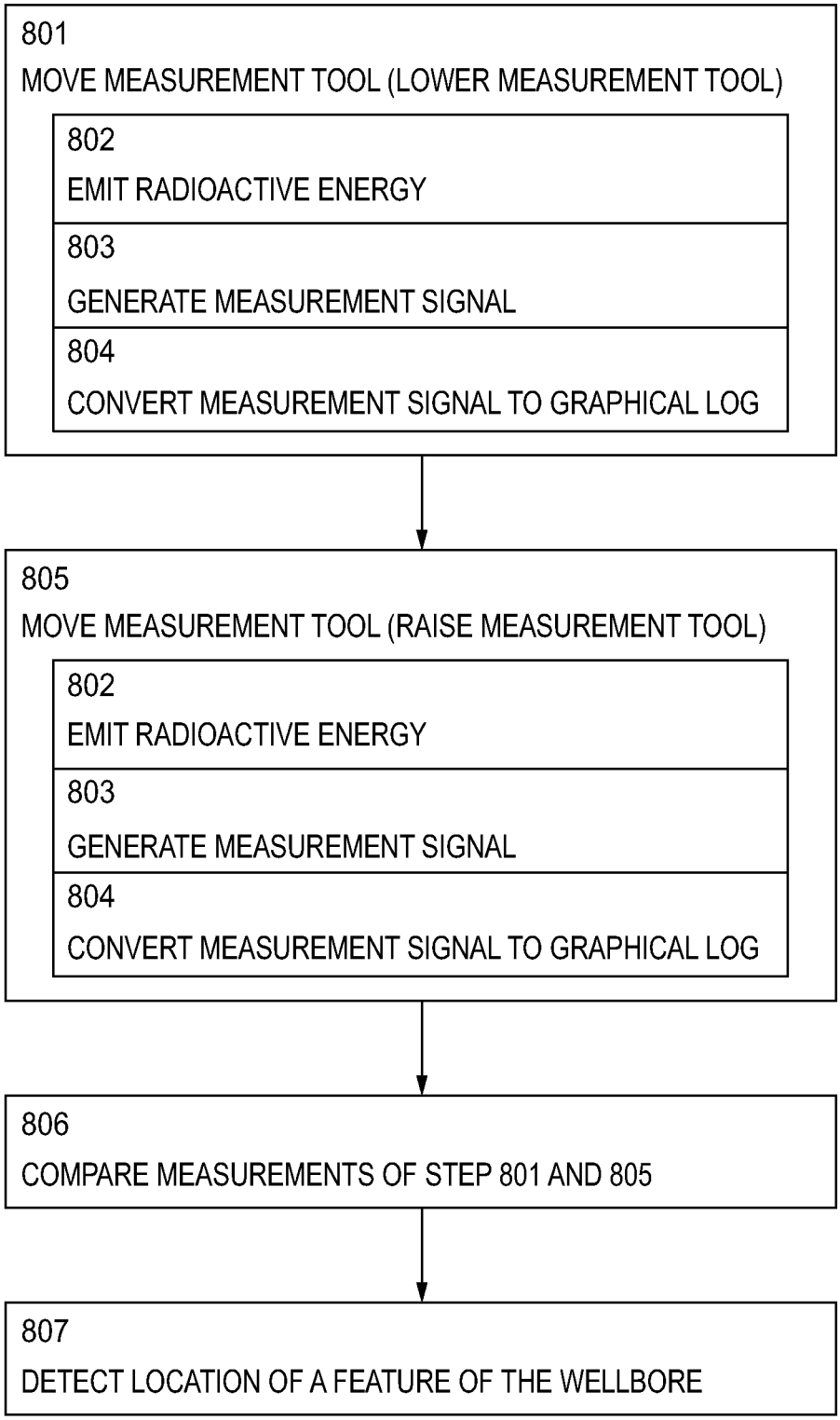
FIG. 8 is a flow diagram of an example of the method of the present invention.

The step diagram shown in FIG. 8 illustrates an example of a method for evaluating cement on the outside 110 of a well casing 101 according to the present invention. At step 801, the measurement tool 2000 is moved at a predetermined rate up or down the bore of the well casing 101. The rate of movement of the measurement tool 2000 affects the time necessary to perform the method, and the accuracy of the results. In some non-limiting examples, the measurement tool 2000 is moved at a rate of about 1,200 feet per hour to about 3,600 feet per hour, or approximately 1,800 feet per hour, although the rate may be adjusted according the desired accuracy of measurement and imposed time constraints. If the measurement tool 2000 is being lowered, the caliper arm 202 is retracted. If the measurement tool 2000 is being raised, the caliper arm 202 is extended.

The remaining steps of the method occur concurrently with moving the measurement tool 2000 in the well casing 101, and are as follows. At step 802, radioactive energy, such as a gamma ray, is emitted from the radiation source 203 at a predetermined energy level towards a wall of the well casing 101. The radioactive energy travels along one or more travel paths P1, P2 through the well casing 101 and the surrounding formation, at which point the energy loss of the radioactive energy is measured by the one or more detectors 204, 205. At step 803, the one or more detectors 204, 205 each generate a measurement signal which is transmitted along the wireline 3000, or wirelessly, to the computing device 4000. At step 804, the at least one processor 401 of the computing device 4000 converts the measurement signals into respective data points and generates a graphical or numerical log of the wellbore 1000 including all previously gathered data points. The log of the wellbore 1000 may be presented on a GUI of the computing device 4000.

In some examples, such as shown in FIG. 8, the method comprises both lowering the measurement tool 2000 into the well casing 101 (step 801) and raising the measurement tool 2000 from the well casing 101 (step 805). In such examples, energy loss measurements along the height of the well casing 101 are taken twice—once during the lowering step 801 and again during the raising step 805. At step 806, the at least one processor 401 of the computing device 4000 may compare the measurements taken during the lowering step 801 with the measurements taken during the raising step 805 to verify the measurements and/or identify anomalous measurements. In other examples, only one of the lowering step 801 and the raising step 805 may be performed.

At step 807, the location of a feature, such as the TOC 104, of the wellbore 1000 is detected based on the generated graphical or numerical log. The feature of the wellbore 1000 may be detected either automatically by the at least one processor 401 of the computing device 4000, or manually by the operator 5000, by analyzing the measurement signals from the one or more detectors 204, 205. In some examples, such as shown in the log 610 of FIG. 6, the TOC 104 may be identified by an increase in the amplitude of the measurement signals recorded in the graphical or numerical log 610. In such examples, the amplitude of the measurement signals, based on the measured energy loss from the one or more detectors 204, 205, may be lower when the measurement tool 2000 is located at a height H within the well casing 101 where the cement layer 103 is present on the outside 110 of the well casing 101. The amplitude of the measurement signals may increase when the measurement tool 2000 is located within the well casing 101 above the cement layer 103. As the measurement tool 2000 is raised within the well casing 101, the computing device 4000 or the operator 5000 may detect the TOC 104 by identifying the point at which the amplitude of the measurement signals increases, indicating that the cement layer 103 is no longer present on the outside 110 of the well casing 101 at the location of the measurement tool 2000. Similarly, as the measurement tool 2000 is lowered within the well casing 101, the computing device 4000 or the operator 5000 may detect the TOC 104 by identifying the height H at which the amplitude of the measurement signals decreases, indicating that the cement layer 103 is present on the outside 110 of the well casing 101 at the location of the measurement tool 2000.

Figure 9:
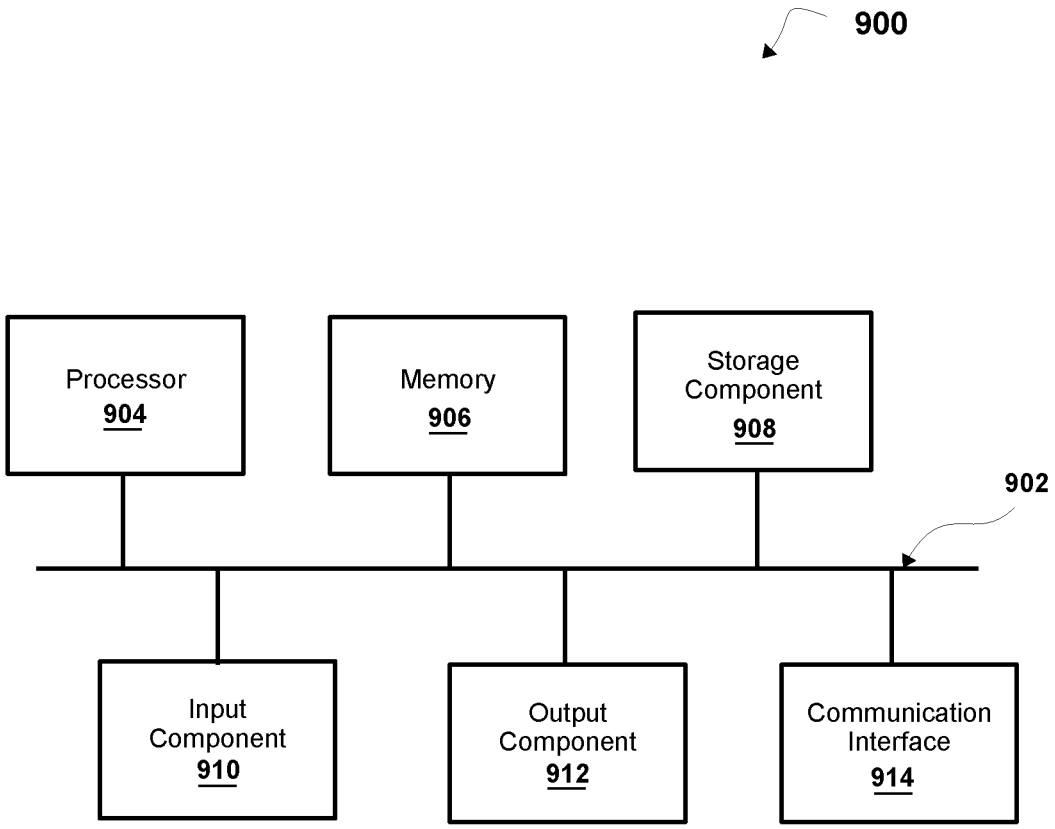
FIG. 9 is a diagram of components of one or more devices of the present invention.

FIG. 9 shows a diagram of example components of a device 900. In some examples, the device 900 may correspond to one or more devices of the measurement tool 2000 and/or one or more devices of the computing device 4000. In some aspects, the measurement tool 2000 and/or the computing device 4000 may each include at least one device 900 and/or at least one component of the device 900. As shown in FIG. 9, the device 900 may include a bus 902, a processor 904, memory 906, a storage component 908, an input component 910, an output component 912, and a communication interface 514.

The bus 902 may include a component that permits communication among the components of the device 900. In some aspects, the processor 904 may be implemented in hardware, firmware, or a combination of hardware and software. For example, the processor 904 may include a processor (e.g., a central processing unit (CPU), a graphics processing unit (GPU), an accelerated processing unit (APU), and/or the like), a microprocessor, a digital signal processor (DSP), and/or any processing component (e.g., a field-programmable gate array (FPGA), an application-specific integrated circuit (ASIC), and/or the like), and/or the like, which can be programmed to perform a function. The memory 906 may include random access memory (RAM), read-only memory (ROM), and/or another type of dynamic or static storage device (e.g., flash memory, magnetic memory, optical memory, and/or the like) that stores information and/or instructions for use by the processor 904.

The storage component 908 may store information and/or software related to the operation and use of the device 900. For example, the storage component 908 may include a hard disk (e.g., a magnetic disk, an optical disk, a magneto-optic disk, a solid state disk, and/or the like), a compact disc (CD), a digital versatile disc (DVD), a floppy disk, a cartridge, a magnetic tape, and/or another type of computer-readable medium, along with a corresponding drive.

The input component 910 may include a component that permits the device 900 to receive information, such as via user input (e.g., a touch screen display, a keyboard, a keypad, a mouse, a button, a switch, a microphone, and/or the like). Additionally, or alternatively, the input component 910 may include a sensor for sensing information (e.g., a global positioning system (GPS) component, an accelerometer, a gyroscope, an actuator, a radiation sensor, and/or the like). The output component 912 may include a component that provides output information from the device 900 (e.g., a display, a speaker, one or more light-emitting diodes (LEDs), and/or the like). The input component 910 and/or the output component 912 may correspond to, be included in, or include the measurement tool 2000 and/or the computing device 4000.

The communication interface 914 may include a transceiver-like component (e.g., a transceiver, a receiver and transmitter that are separate, and/or the like) that enables the device 900 to communicate with other devices, such as via a wired connection, a wireless connection, or a combination of wired and wireless connections. The communication interface 914 may permit the device 900 to receive information from another device and/or provide information to another device. For example, the communication interface 914 may include an Ethernet interface, an optical interface, a coaxial interface, an infrared interface, a radio frequency (RF) interface, a universal serial bus (USB) interface, a Wi-Fi® interface, a cellular network interface, and/or the like.

The device 900 may perform one or more processes described herein. The device 900 may perform these processes based on the processor 904 executing software instructions stored by a computer-readable medium, such as the memory 906 and/or the storage component 908. A computer-readable medium (e.g., a non-transitory computer-readable medium) is defined herein as a non-transitory memory device. A memory device includes memory space located inside of a single physical storage device or memory space spread across multiple physical storage devices.

Software instructions may be read into the memory 906 and/or the storage component 908 from another computer-readable medium or from another device via the communication interface 914. When executed, the software instructions stored in the memory 906 and/or the storage component 908 may cause the processor 904 to perform one or more processes described herein. Additionally, or alternatively, hardwired circuitry may be used in place of or in combination with the software instructions to perform one or more processes described herein. Thus, aspects described herein are not limited to any specific combination of hardware circuitry and software.

The number and arrangement of the components shown in FIG. 9 are provided as an example. In some aspects, the device 900 may include additional components, fewer components, different components, or differently arranged components than those shown in FIG. 9. Additionally, or alternatively, a set of components (e.g., one or more components) of the device 900 may perform one or more functions described as being performed by another set of components of the device 900.

While various examples of methods and systems for evaluating cement are provided in the foregoing description, those skilled in the art may make modifications and alterations to these examples without departing from the scope and spirit of the invention. For example, it is to be understood that this disclosure contemplates that, to the extent possible, one or more features of any example can be combined with one or more features of any other example. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. A method of logging a wellbore casing and an adjacent formation, the method comprising:

moving a measurement tool inside a borehole of the casing, wherein the borehole is filled with air, and, concurrently with moving the measurement tool inside the borehole:

emitting radioactive energy at an initial energy level from a radiation source of the measurement tool, wherein the radioactive energy is directed toward a wall of the casing and along a travel path from the radiation source to one or more detectors of the measurement tool;

measuring energy loss of the radioactive energy at the one or more detectors relative to the initial energy level; and detecting a cement property outside of the casing based on the measured energy loss, wherein the radiation source comprises Cesium-137 having a Curie strength of 1.8 to 2.0 curie.

2. The method of claim 1, wherein detecting the cement property outside of the casing comprises:

transmitting the measured energy loss to a computing device; and generating, with at least one processor of the computing device, a log of the measured energy loss as a function of depth of the measurement tool in the wellbore.

3. The method of claim 1, wherein detecting the cement property outside of the casing comprises detecting the presence or absence of cement between the casing and the formation.

4. The method of claim 1, wherein detecting the cement property outside of the casing comprises detecting the quality of cement present between the casing and the formation.

5. The method of claim 1, wherein the radioactive energy is a gamma ray.

6. The method of claim 5, wherein the gamma ray is emitted at an energy level of 660 kilo-electronvolts.

7. The method of claim 1, wherein moving the measurement tool inside the borehole comprises:

lowering the measurement tool into the borehole to a predetermined depth with a caliper arm of the measurement tool retracted;

extending the caliper arm to brace the measurement tool against the borehole; and raising the measurement tool from the predetermined depth out of the borehole.

8. The method of claim 1, wherein the measurement tool has a depth of measurement of up to 6 inches.

9. The method of claim 1, wherein the measurement tool has a vertical resolution of 10 inches.

10. A system for logging a wellbore casing and an adjacent formation of a wellbore, the system comprising:

a measurement tool configured to be moved inside a borehole of the casing, the measurement tool comprising:

a radiation source configured to emit radioactive energy at an initial energy level directed toward a wall of the casing and along a travel path; and one or more detectors configured to measure energy loss of the radioactive energy relative to the initial energy level and generate one or more measurement signals based on the measured energy loss;

wherein the one or more detectors are configured to measure energy loss when the wellbore is filled with air;

a computing device configured to receive the one or more measurement signals, the computing device comprising at least one processor configured to convert the one or more measurement signals into a graphical log of the wellbore; and a wireline extending between the measurement tool and the computing device, the wireline configured to carry instructions from the computing device to the measurement tool and to carry the one or more measurement signals from the measurement tool to the computing device, wherein the radiation source comprises Cesium-137 having a Curie strength of 1.8 to 2.0 curie.

11. The system of claim 10, wherein the radioactive energy is a gamma ray.

12. The system of claim 11, wherein the gamma ray is emitted at an energy level of 660 kilo-electronvolts.

13. The system of claim 10, wherein the measurement tool is configured to be moved inside the borehole of the casing by:

lowering the measurement tool into the borehole to a predetermined depth with a caliper arm of the measurement tool retracted;

extending the caliper arm to brace the measurement tool against the borehole; and raising the measurement tool from the predetermined depth out of the borehole.

14. The system of claim 10, wherein the measurement tool has a depth of measurement of up to 6 inches.

15. The system of claim 10, wherein the measurement tool has a vertical resolution of 10 inches.

16. The system of claim 10, wherein the computing device is configured to detect a cement property outside of the casing based on the one or more measurement signals.

17. A method of logging a wellbore casing and an adjacent formation, the method comprising:

moving a measurement tool inside a borehole of the casing, wherein the borehole is filled with air, and, concurrently with moving the measurement tool inside the borehole:

emitting radioactive energy at an initial energy level from a radiation source of the measurement tool, wherein the radioactive energy is directed toward a wall of the casing and along a travel path from the radiation source to one or more detectors of the measurement tool; measuring energy loss of the radioactive energy at the one or more detectors relative to the initial energy level; and determining a location of a top of cement in the wellbore based on the measured energy loss, wherein the radiation source comprises Cesium-137 having a Curie strength of 1.8 to 2.0 curie.

18. A system for logging a wellbore casing and an adjacent formation of a wellbore, the system comprising:

a measurement tool configured to be moved inside a borehole of the casing, the measurement tool comprising:

a radiation source configured to emit radioactive energy at an initial energy level directed toward a wall of the casing and along a travel path; and one or more detectors configured to measure energy loss of the radioactive energy relative to the initial energy level and generate one or more measurement signals based on the measured energy loss;

wherein the one or more detectors are configured to measure energy loss when the wellbore is filled with air;

a computing device configured to receive the one or more measurement signals, the computing device comprising at least one processor configured to convert the one or more measurement signals into a graphical log of the wellbore; and a wireline extending between the measurement tool and the computing device, the wireline configured to carry instructions from the computing device to the measurement tool and to carry the one or more measurement signals from the measurement tool to the computing device, wherein the computing device is programmed or configured to determine a location of a top of cement in the wellbore based on the one or more measurement signals, wherein the radiation source comprises Cesium-137 having a Curie strength of 1.8 to 2.0 curie.

* * * * *